US008844549B2

(12) United States Patent
Mohamed

(10) Patent No.: US 8,844,549 B2
(45) Date of Patent: Sep. 30, 2014

(54) MODULAR OUTDOOR PLAYPEN APPARATUS

(76) Inventor: Hinda A. Mohamed, Tukwila, WA (US)

( * ) Notice: Subject to any disclaimer, the term of this patent is extended or adjusted under 35 U.S.C. 154(b) by 0 days.

(21) Appl. No.: 12/838,678

(22) Filed: Jul. 19, 2010

(65) Prior Publication Data

US 2012/0012143 A1 Jan. 19, 2012

(51) Int. Cl.
*E04H 15/02* (2006.01)
*A47D 7/01* (2006.01)

(52) U.S. Cl.
USPC ..... 135/96; 5/99.1

(58) Field of Classification Search
USPC ..... 135/96, 116; 220/4.31; 256/24, 25; 5/93.1, 99.1, 97, 100
See application file for complete search history.

(56) References Cited

U.S. PATENT DOCUMENTS

| | | | | | |
|---|---|---|---|---|---|
| 1,782,217 | A | * | 11/1930 | Stoddard | 5/99.1 |
| 2,253,024 | A | * | 8/1941 | Farrand | 5/98.1 |
| 3,218,037 | A | * | 11/1965 | Corley | 256/25 |
| 4,003,098 | A | * | 1/1977 | Fink | 5/93.1 |
| 4,698,862 | A | * | 10/1987 | Mairs | 5/98.1 |
| 5,035,013 | A | | 7/1991 | Bloom | |
| 5,473,785 | A | | 12/1995 | Lager et al. | |
| 5,577,276 | A | * | 11/1996 | Nicholson et al. | 5/424 |
| 6,119,288 | A | * | 9/2000 | Hendrickson | 5/97 |
| 6,408,463 | B1 | | 6/2002 | Palacio | |
| 6,450,123 | B1 | * | 9/2002 | Murray et al. | 119/512 |
| 7,117,552 | B2 | * | 10/2006 | Hoffman | 5/655 |
| 7,867,101 | B2 | * | 1/2011 | Chiang | 472/134 |
| 2005/0108823 | A1 | | 5/2005 | Chabot | |
| 2009/0049609 | A1 | | 2/2009 | Long et al. | |

* cited by examiner

*Primary Examiner* — Noah Chandler Hawk

(57) ABSTRACT

A modular outdoor playpen apparatus including a room-sized enclosure, having an area in a range of 10 square feet to 20 square feet, the enclosure having a cushioned bottom wall, an open top, four side panels releasably hingedly attached to each other, a unitary cushioned padding removably disposed over all of the entire inner walls of the side panels, and a padded covering removably disposed over the bottom wall between the side panels. The apparatus also provides a canopy that attaches to the cushioned padding.

6 Claims, 4 Drawing Sheets

MODULAR OUTDOOR PLAYPEN APPARATUS

BACKGROUND OF THE INVENTION

Various types of infant playpens are known in the prior art. However, what is needed is a modular outdoor playpen apparatus having a room-sized enclosure with an open top and cushioned bottom wall, and a plurality of side panels that releasably hingedly attached to one another, a cushioned padding continuously disposed along the side panels, a canopy having support members attached to a top edge of the cushioned padding, a padded covering that fits atop the bottom wall.

FIELD OF THE INVENTION

The present invention relates to infant playpens, and more particularly, to a modular outdoor playpen apparatus.

SUMMARY OF THE INVENTION

The general purpose of the present modular outdoor playpen apparatus, described subsequently in greater detail, is to provide a modular outdoor playpen apparatus which has many novel features that result in a modular outdoor playpen apparatus which is not anticipated, rendered obvious, suggested, or even implied by prior art, either alone or in combination thereof.

To accomplish this, the present modular outdoor playpen apparatus includes a room-sized enclosure, having an area in a range of 10 square feet to 20 square feet, the enclosure having a cushioned bottom wall, an open top, four side panels releasably hingedly attached to each other, a unitary padded covering removably disposed over all of the entire inner walls of the side panels, and a machine-washable padded covering removably disposed over the bottom wall between the side panels. The apparatus also provides a canopy that attaches to a top end of each of the side panels. The canopy protects a baby from harmful sun rays.

The enclosure is room-sized in that the enclosure has an area in the range of approximately 100 square feet to 200 square feet which is critical to allow a child to move about freely, while confining the child within safe boundaries while using the apparatus outdoors, contrary to a conventional portable playpen that is typically has minimal square footage in a range of 9 square feet to 25 square feet which severely curtails a child's ability to move about freely. In addition, each of the side panels has a height in a range of 10 inches to 16 inches allowing a baby to crawl or walk within the enclosure. The side panels may be formed of sturdy, durable plastic for quick and easy cleaning and to ensure that the side panels and side wall are lightweight for portability. The bottom wall and cushioned padding may be rubberized.

The present apparatus may also be used indoors. The present modular outdoor playpen apparatus eliminates the need for extra baby-proofing efforts when used indoors, such as covering outlets, thus saving time and effort. The present apparatus is easily and quickly disassembled for transport to any location.

Thus has been broadly outlined the more important features of the present modular outdoor playpen apparatus so that the detailed description thereof that follows may be better understood and in order that the present contribution to the art may be better appreciated.

Numerous objects, features and advantages of the present modular outdoor playpen apparatus will be readily apparent to those of ordinary skill in the art upon reading the following detailed description of presently preferred, but nonetheless illustrative, examples of the present modular outdoor playpen apparatus when taken in conjunction with the accompanying drawings. In this respect, before explaining the current examples of the present modular outdoor playpen apparatus in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the modular outdoor playpen apparatus and method. It is therefore important that the claims be regarded as including such equivalent constructions insofar as they do not depart from the spirit and scope of the present invention.

Objects of the present modular outdoor playpen apparatus and method, along with various novel features that characterize the invention are particularly pointed out in the claims forming a part of this disclosure. For better understanding of the modular outdoor playpen apparatus and method, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
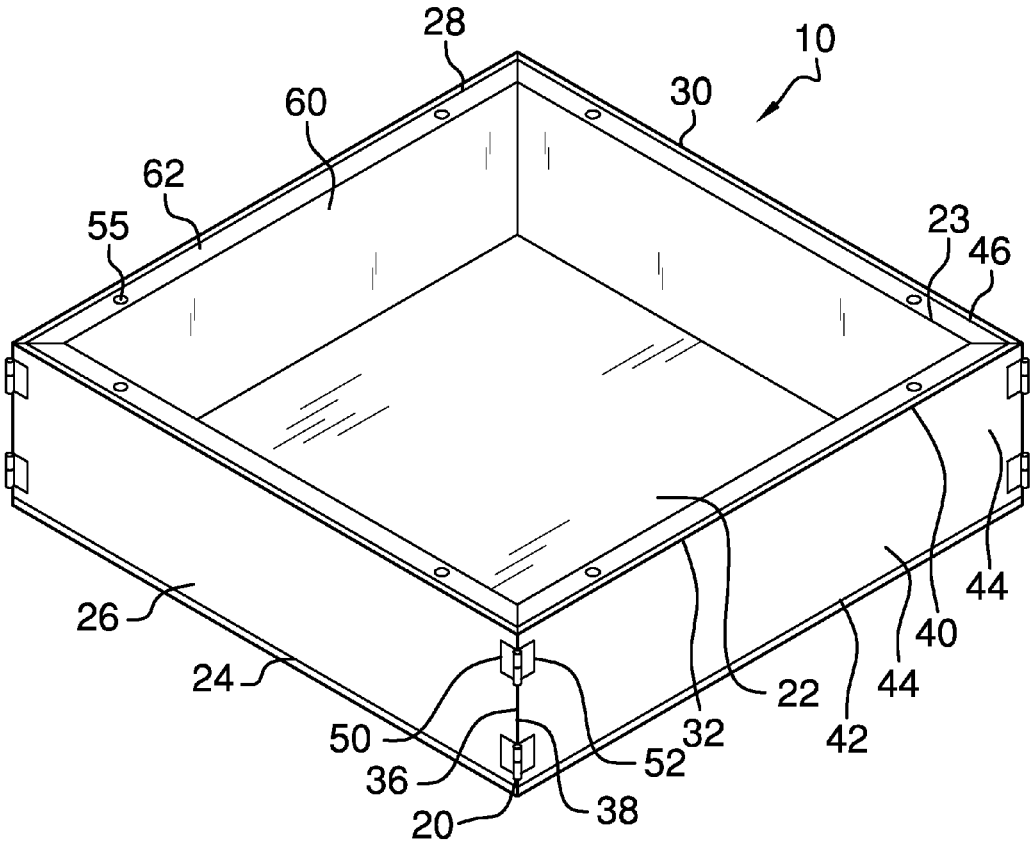
FIG. 1 is an isometric view.
Figure 2:
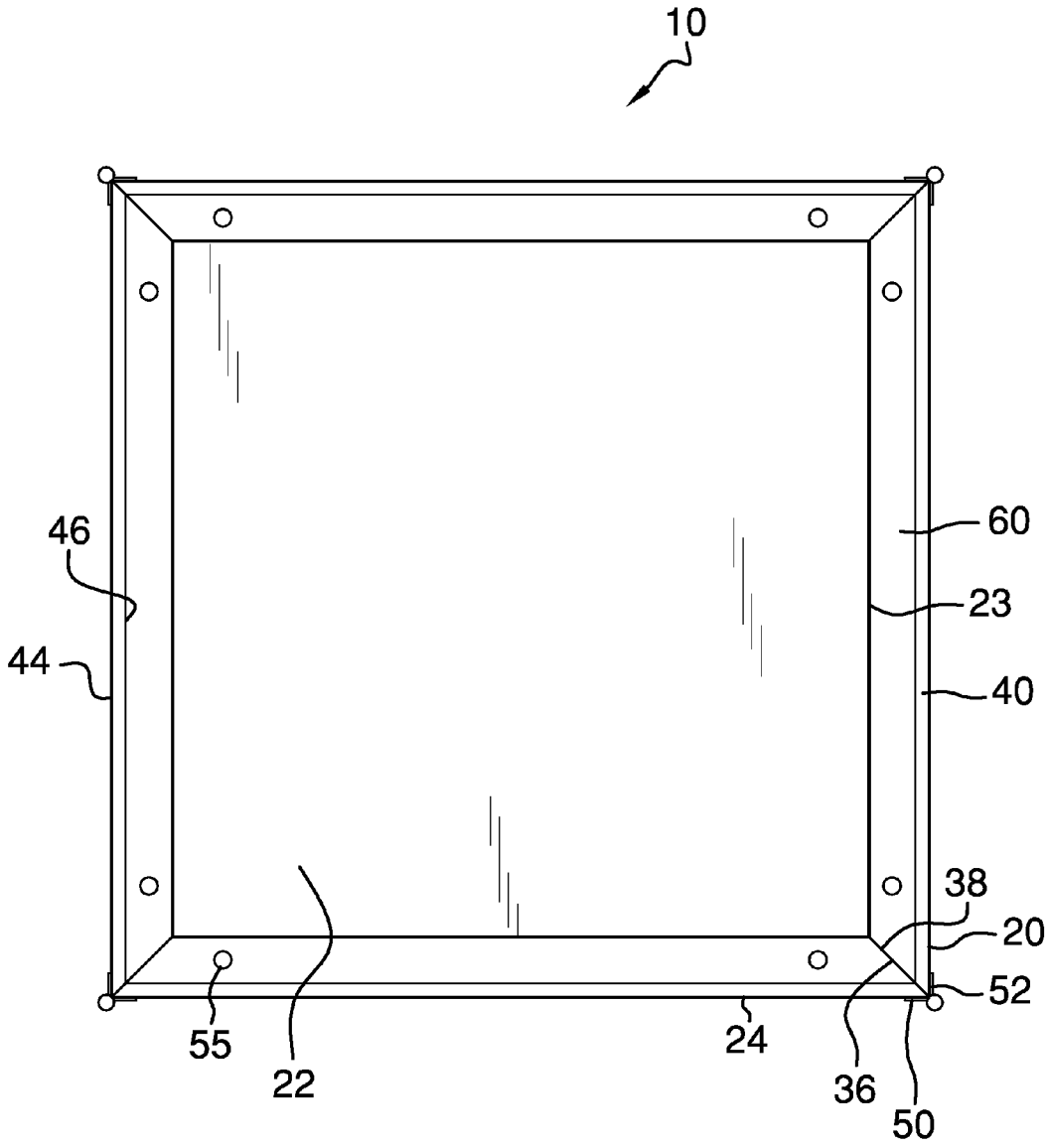
FIG. 2 is a top plan view.
Figure 3:
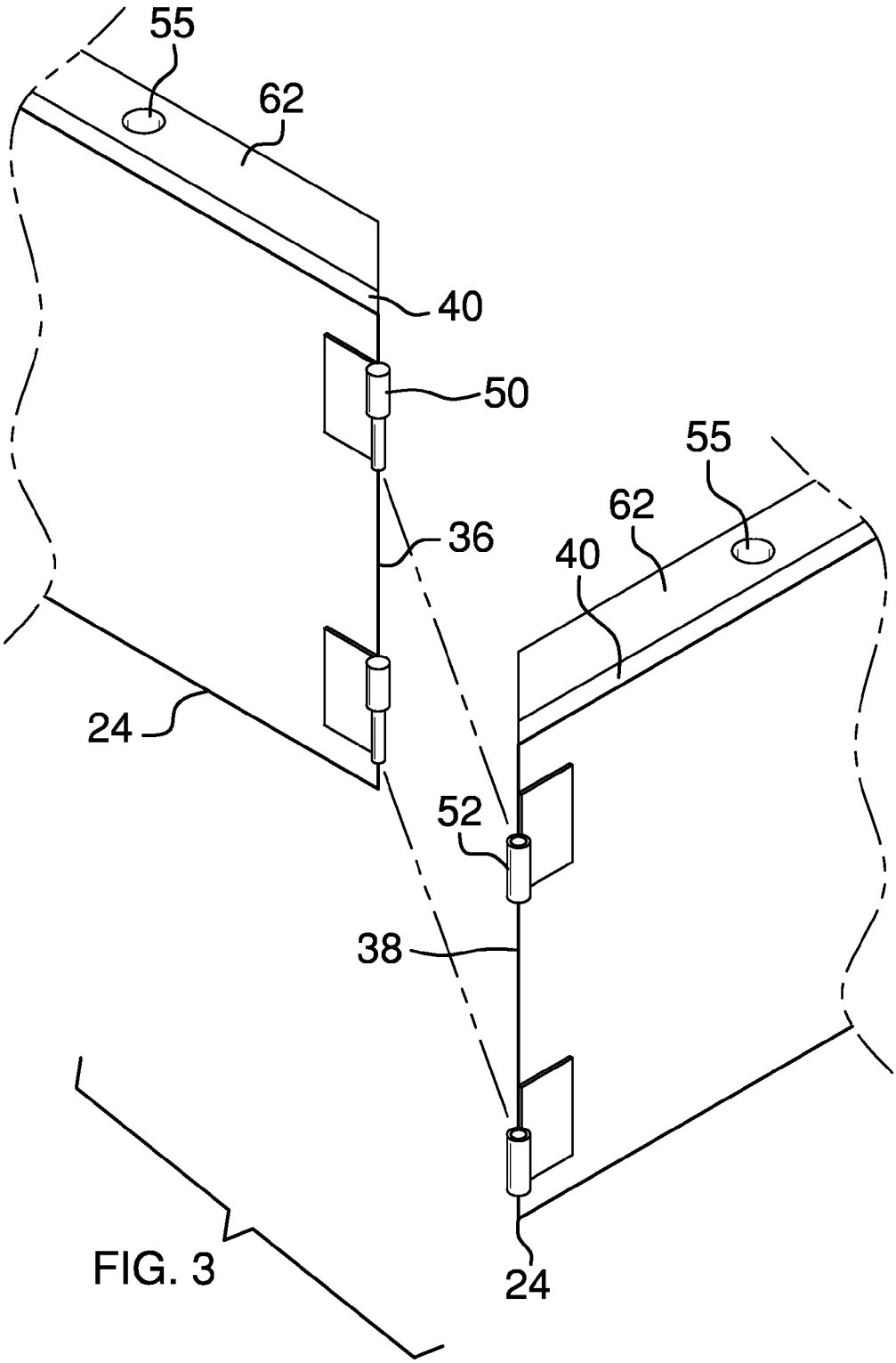
FIG. 3 is a detail view illustrating the removable attachment of a male hinge to a female hinge.
Figure 4:
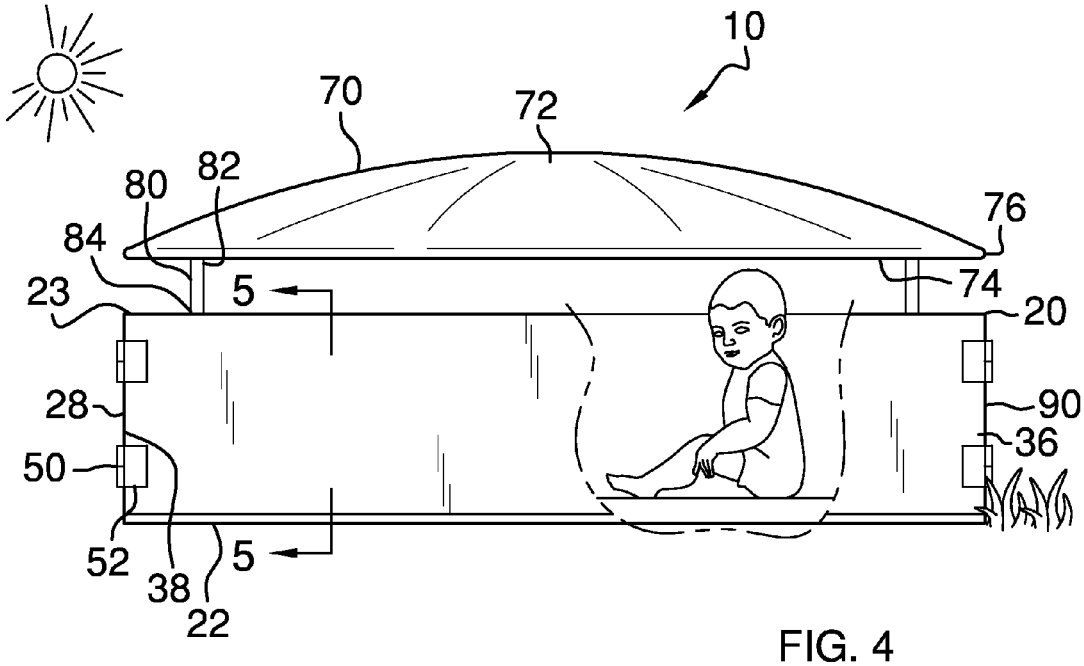
FIG. 4 is a front elevation view illustrating the apparatus with a canopy installed thereon.
Figure 5:
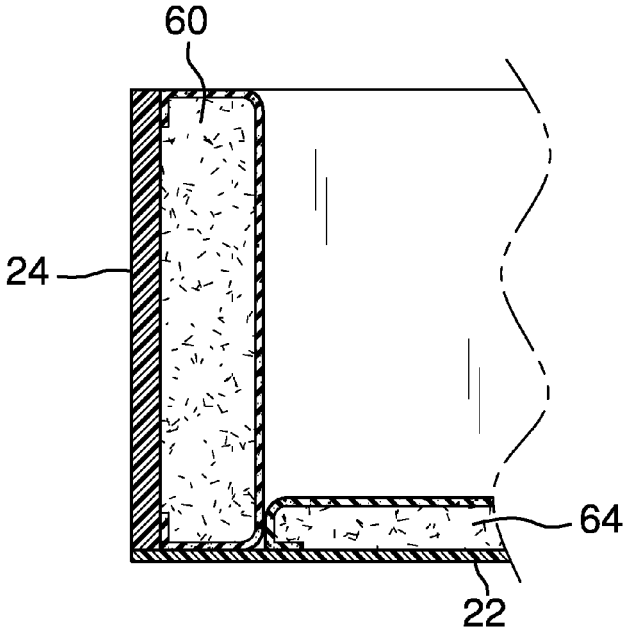
FIG. 5 is a cross-section view taken along line 5-5 of FIG. 4.

With reference now to the drawings, and in particular FIGS. 1 through 5 thereof, example of the instant modular outdoor playpen apparatus employing the principles and concepts of the present modular outdoor playpen apparatus and generally designated by the reference number 10 will be described.

Referring to FIGS. 1 through 5 a preferred embodiment of the present modular outdoor playpen apparatus 10 is illustrated. The modular outdoor playpen apparatus 10 includes an enclosure 20. The enclosure 20 has a cushioned bottom wall 22 and an opposite open top 23. The enclosure 20 also has a plurality of elongated parallelpiped side panels 24 comprising a first side panel 26, a second side panel 28, a third side panel 30, and a fourth side panel 32.

Each of the side panels 24 has a first end 36 and an opposite second end 38, a top end 40 and an opposite bottom end 42, an outer wall 44 and an opposite inner wall 46. A pair of vertically aligned male hinges 50 is disposed on a first end 36 of each side panel 24. A pair of vertically aligned female hinges 52 is disposed on a second end 38 of each side panel 24. Each pair of vertically aligned male hinges 50 releaseably engages one of the pair of vertically aligned female hinges 52. Each of the male hinges 50 disposed on the first side panel 26 releaseably engages each of the female hinges 52 disposed on the fourth side panel 32. Each of the male hinges 50 disposed on the second side panel 28 releaseably engages each of the female hinges 52 disposed on the first side panel 26. Each of the male hinges 50 disposed on the third side panel 30 releaseably engages each of the female hinges 52 disposed on the second side panel 28. Each of the male hinges 50 disposed on the fourth side panel 32 releaseably engages each of the female hinges 52 disposed on the third side panel 30.

The present apparatus 10 also includes a unitary hollow parallelepiped cushioned padding 60 continuously disposed along all of the inner walls 46 of the side panels 24. The cushioned padding 60 has a continuous top edge 62. The cushioned padding 60 has a height slightly greater than the height of the inner walls 46 of the side panels 24. At least one mounting hole 55 disposed in the top edge 62 of cushioned padding 60 proximal to each of the side panels 24. The present apparatus 10 further includes a machine-washable padded covering 64 removably disposed over the bottom wall 22 between the side panels 24.

The present modular outdoor playpen apparatus 10 also includes a canopy 70 removably attached to the cushioned padding 60. The canopy 70 has a top side 72, a bottom side 74, and a perimeter 76. The canopy 70 has an area that is substantially equal to an area of the bottom wall 22 of the enclosure 20. At least four spaced apart cylindrical support members 80 that support the canopy 70 are also provided. Each support member 80 has an upper end 82 attached to the bottom side of the canopy 70 and a lower end 84 releasably, securingly engaging one of the mounting holes 55.

The enclosure 20 is room-sized in that the enclosure 20 has an area in the range of approximately 100 square feet to 200 square feet which is critical to allow a child to move about freely, while confining the child within safe boundaries, contrary to a conventional portable playpen that is typically has minimal square footage in a range of 9 square feet to 25 square feet which severely curtails a child's ability to move about freely. In addition, each of the side panels has a height in a range of 10 inches to 16 inches allowing a baby to crawl or walk within the enclosure 20. The interchangeable side wall 90 has a height in a range of 18 inches to 24 inches whereby the side wall replaces one of the side panels 24, 26, 28, 30, 32 with a taller panel, thereby providing a surface for a baby to grip while learning to walk within the boundaries of the enclosure 20. The side panels 24, 26, 28, 30, 32 and side wall 90 may be formed of sturdy, durable plastic. The bottom wall 22 and cushioned padding 60 may be rubberized.

Use:

To use the present modular outdoor playpen 10, a user releasably attaches each of the male hinges 52 disposed on the first side panel 26 to each of the female hinges 52 disposed on the fourth side panel 32, each of the male hinges 50 disposed on the second side panel 28 to each of the female hinges 52 disposed on the first side panel 26, each of the male hinges 50 disposed on the third side panel 28 to each of the female hinges 52 disposed on the second side panel 28; and each of the male hinges 50 disposed on the fourth side panel 32 to each of the female hinges 52 on the third side panel 30. The user places the assembled side panels 26-32 atop the bottom wall 22. The user then removably positions the cushioned padding 60 against the inner walls 46 of the side panels 26-32. The user then covers the bottom wall between the side panels 24 with the padded covering 64. If the user desires to attach the canopy, the user engages the lower end 84 of each support member 80 within one of the mounting holes 55. If the user wishes to replace one of the side panels 24 with the side wall 90, the user simply unhinges and removes one of the side panels 26-32 and hingedly attaches the side wall 90 in place of the removed side panel 26-32.

With respect to the above description then, it is to be realized that the optimum dimensional relationships for the parts of the present modular outdoor playpen apparatus to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A modular outdoor playpen apparatus comprising:

an enclosure comprising:

a cushioned bottom wall;

an opposite open top;

a plurality of elongated parallelpiped side panels comprising a first side panel; a second side panel; a third side panel, and a fourth side panel;

a first end and an opposite second end of each side panel;

a top end and an opposite bottom end of each side panel;

an outer wall and an opposite inner wall of each side panel;

a pair of vertically aligned male hinges disposed on a first end of each side panel;

a pair of vertically aligned female hinges disposed on a second end of each side panel;

wherein each pair of vertically aligned male hinges releaseably engages one of the pair of vertically aligned female hinges;

wherein the enclosure has an area in a range of 12 square feet to 20 square feet;

wherein each of the male hinges disposed on the first side panel releaseably engages each of the female hinges disposed on the fourth side panel;

wherein each of the male hinges disposed on the second side panel releaseably engages each of the female hinges disposed on the first side panel;

wherein each of the male hinges disposed on the third side panel releaseably engages each of the female hinges disposed on the second side panel;

wherein each of the male hinges disposed on the fourth side panel releaseably engages each of the female hinges disposed on the third side panel;

a unitary hollow parallelepiped cushioned padding continuously removably disposed along the inner walls of the side panels, the cushioned padding having a continuous top edge; and at least one mounting hole disposed in the top edge of cushioned padding proximal to each of the side panels.

2. The modular outdoor playpen apparatus of claim 1 wherein the bottom wall is cushioned by a machine-washable padded covering removably disposed over the bottom wall between the side panels.

3. The modular outdoor playpen apparatus of claim 2 further comprising:

a canopy removably attached to the cushioned padding, the canopy comprising a top side, a bottom side, and a perimeter, the canopy having a surface area that is substantially equal to a surface area of the bottom wall;

at least four spaced apart cylindrical support members, each support member having an upper end and a lower end, the upper end attached to the bottom side of the canopy and the lower end releasably, securingly engaging one of the mounting holes.

4. A modular outdoor playpen apparatus comprising:

an enclosure comprising:

a bottom wall;

an opposite open top;

a plurality of elongated parallelpiped side panels comprising a first side panel; a second side panel; a third side panel, and a fourth side panel;

a first end and a second end of each side panel;

a top end and a bottom end of each side panel;

an outer wall and an inner wall of each side panel;

a pair of vertically aligned male hinges disposed on a first end of each side panel;

a pair of vertically aligned female hinges disposed on a second end of each side panel;

wherein each pair of vertically aligned male hinges releaseably engages one of the pair of vertically aligned female hinges;

wherein each of the male hinges disposed on the first side panel releaseably engages each of the female hinges disposed on the fourth side panel;

wherein each of the male hinges disposed on the second side panel releaseably engages each of the female hinges disposed on the first side panel;

wherein each of the male hinges disposed on the third side panel releaseably engages each of the female hinges disposed on the second side panel;

wherein each of the male hinges disposed on the fourth side panel releaseably engages each of the female hinges disposed on the third side panel;

a unitary hollow parallelepiped cushioned padding continuously removably disposed along the inner walls of the side panels, the cushioned padding having a continuous top edge;

a machine-washable padded covering removably disposed over the bottom wall between the side panels at least one mounting hole disposed in the top edge of cushioned padding proximal to each of the side panels;

a canopy removably attached to the cushioned padding, the canopy comprising a top side, a bottom side, and a perimeter, the canopy having a surface area that is substantially equal to a surface area of the bottom wall;

at least four spaced apart cylindrical support members, each support member having an upper end and a lower end, the upper end attached to the bottom side of the canopy and the lower end releasably, securingly engaging one of the mounting holes.

5. The modular outdoor playpen apparatus of claim 4 wherein the enclosure has an area in a range of 10 square feet to 20 square feet; and wherein each of the side panels has a height in a range of 10 inches to 16 inches.

6. The modular outdoor playpen apparatus of claim 5 wherein the side panels are formed of sturdy, durable plastic.

* * * * *